US007458174B1

(12) United States Patent
Gustin et al.

(10) Patent No.: US 7,458,174 B1
(45) Date of Patent: Dec. 2, 2008

(54) NEEDLE PUNCH STRETCH HOOP

(75) Inventors: Clella Gustin, Spanish Fork, UT (US); Jared Burton, Payson, UT (US); Chad McBride, West Jordan, UT (US); Gerry Ayala, Provo, UT (US)

(73) Assignee: Provo Craft and Novelty, Inc., Spanish Fork, UT (US)

( * ) Notice: Subject to any disclaimer, the term of this patent is extended or adjusted under 35 U.S.C. 154(b) by 0 days.

(21) Appl. No.: 11/891,577

(22) Filed: Aug. 9, 2007

(51) Int. Cl.
*D05C 1/02* (2006.01)
*D06C 3/08* (2006.01)

(52) U.S. Cl. ..... 38/102.2; 38/102.91

(58) Field of Classification Search ..... 38/102.2, 38/102.4, 102.91, 102, 102.21; 160/378, 160/398, 380, 404
See application file for complete search history.

(56) References Cited

U.S. PATENT DOCUMENTS 800,591 A * 9/1905 Payen ..... 38/102.4
3,226,861 A * 1/1966 Bird ..... 38/102.91
3,885,333 A * 5/1975 Zachary ..... 38/102.2
3,922,804 A * 12/1975 Batey ..... 38/102.91
3,950,869 A * 4/1976 Samarin ..... 38/102.91
4,079,529 A * 3/1978 Jennen et al. ..... 38/102.2
4,277,901 A * 7/1981 Williams ..... 38/102.2
5,033,529 A * 7/1991 Koschade ..... 160/398
5,293,704 A * 3/1994 Brown ..... 38/102.9
6,209,240 B1 * 4/2001 Engle ..... 38/102.91

OTHER PUBLICATIONS http://www.shuttleworks.com/gripper_strips.html.
http://www.shuttleworks.com/lap_frame.html.
http://www.howardbrush.com/rughook.html.
http://www.howardbrush.com/handcards.html.
http://www.woolenwhimsies.com/index.html.
http://www.woolenwhimsies.com/supplies.html.
http://www.woolenwhimsies.com/images/supplies/frame.jpg.
http://www.lesliesframes.com/rughookingframes.htm.
http://www.amherst-antiques-folkart.com/PunchNeedle_Supplies.htm.
http://www.rughookingonline.com/frames/frames.html.

* cited by examiner

*Primary Examiner*—Ismael Izaguirre
(74) *Attorney, Agent, or Firm*—Honigman Miller Schwartz and Cohn LLP

(57) ABSTRACT

The invention relates to an embroidery frame and a frame cover configured to mate with the fabric frame and align a fabric frame opening with a frame cover opening to provide a single embroidery frame opening, where the frame cover has a plurality of engagement members adapted to releasably engage the fabric frame and cover the gripper strips.

22 Claims, 10 Drawing Sheets

NEEDLE PUNCH STRETCH HOOP

TECHNICAL FIELD

This invention relates to a fabric frame and frame cover system for use in embroidery, for example, needlepoint, punch needle or cross-stitch.

BACKGROUND

Embroidery is the art of creating a picture, pattern or other visually pleasing image on a base fabric by stitching a pattern onto the base fabric. Typically, the base fabric is stretched taut using a frame and colored threads are passed through the base fabric using a needle. For smaller works, typically a small personal fabric mount is used to stretch the base fabric, such as a hoop frame. For larger designs, a scroll frame may be used.

Small personal fabric mounts typically hold the fabric by way of friction generated between two components of the frame or mounting system. For example, a commonly used needlepoint frame is the embroidery hoop frame, which consists of a continuous circular, inner, piece of smooth plastic or wood, and a smooth outer circular piece having an expansion joint and tensioning means. The fabric is draped over the inner piece, the outer piece is then pulled down over the fabric and tightened to form two concentric circles with the fabric friction fit between them. While these hoop frames and other friction based mounting systems are commonly used, they suffer from a number of disadvantages, for example, it is difficult or impossible to tightly and uniformly tension the fabric.

Another needlepoint frame is sold under the name "Round-About Punch Needle Frame," and comprises a rectangular wooden frame with four carding strips around each side of the frame, commonly referred to as "a gripper frame". U.S. Pat. No. 3,922,804 describes a rug hooking frame, or gripper frame, with four fabric retaining bars positioned at right angles to one another where each fabric retaining bar has a card clothing holder secured to the upper surface. While gripper frames (i.e., frames employing carding strips) allow the fabric to be pulled taut, the hooks or pins of the carding strips tend to protrude through the base fabric, particularly in work where the base fabric is thin.

Other gripper frames used for rug hooking include, the Puritant, the Pittsburgh Crafting Frame and the Kerr Adjustable-Tilt Frame, as well as frames made by Appleton Krafts and Supplies, Spruce Top Rug Hooking Studios and Anderson Handcrafted Products.

Each of the above gripper frames is made from wood, masonite, metal or other heavy materials and the pins on the gripper or carding strips are exposed during use and storage. Furthermore, the above gripper frames do not provide a means of holding the base fabric onto the hooks or pins during use of the frame. Therefore, there is a need in the art for a light weight, portable and easy to use frame that also protects the user from the pins on the gripper or carding strips.

SUMMARY OF THE INVENTION

The invention relates to an embroidery frame comprising a fabric frame having a fabric frame opening, a top surface, a bottom surface, at least one pair of recesses in the top surface of the fabric frame, wherein the at least one pair of recesses are arranged across the fabric frame opening and configured to receive at least one pair of gripper strips, and a frame cover configured to mate with the fabric frame, where a frame cover opening corresponds in size and geometry to the fabric frame opening to provide a single embroidery frame opening, and the frame cover has a plurality of engagement members extending inwardly from the sides of the of the frame cover that are adapted to releasably engage the bottom surface of the fabric frame and cover the gripper strips.

In an exemplary embodiment, the fabric frame and/or frame cover are a unitary structure. In another exemplary embodiment the embroidery frame is a light weight plastic. In yet another exemplary embodiment, the frame cover 20 is made from a flexible or deformable plastic to facilitate frictional engagement with the fabric frame 10.

The invention also relates to a method of producing an embroidery frame by injection molding a fabric frame and a frame cover, where the frame cover is configured to mate with the fabric frame by way of engagement members and has sufficient flex to allow the frame cover to snap lock with the fabric frame.

The invention also relates to an embroidery method for reducing stress to the base fabric, comprising stretching a base fabric over a fabric frame having a fabric frame opening, a top surface, a bottom surface and at least one pair of gripper strips situated across the fabric frame opening and connected to the top surface of the fabric frame; attaching a frame cover configured to mate with the fabric frame, wherein the frame cover comprises a frame cover opening corresponding in size and geometry to the fabric frame opening, an inner surface, and a plurality of engagement members adapted to releasably engage the bottom surface of the fabric frame and align the frame cover opening above the fabric frame opening and cover the at least one pair of gripper strips; and preventing the force generated by passing a needle and one or more threads through the base fabric to produce an image on the base fabric from disengaging the base fabric from the gripper strips.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION OF THE INVENTION

Figure 1A:
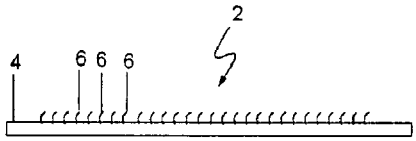
FIG. 1A is a cross-sectional view of a gripper strip.

As used herein, "embroidery" means stitching a pattern onto a base fabric using colored thread or yarn, and includes activities commonly described as needlepoint, cross-stitch, rug hooking, punch needle hooking and speed needle hooking.

As used herein, "gripper strip" includes card clothing strips and similar fabric retaining means comprising a support membrane 4 and a plurality of hooks or pins 6 embedded therein. Gripper strips are commercially available, for example, from Howard Brush.

As used herein, "frame," "fabric frame," or "frame cover" means an enclosing border having an opening enclosed by the border. Hence, a fabric frame has an inside and an outside edge, where the inside edge abuts the opening.

As used herein, an "embroidery frame" means a fabric frame and frame cover system.

As used herein, "a frame cover configured to mate with a fabric frame" means that the inner edges of the frame cover 20 and fabric frame 10 openings (18 and 22) are configured to align when the frame cover 20 is engaged and at least two sides or areas of the frame cover 20 are adapted to run substantially parallel to the surface of the fabric frame 14 and releasably attach to the frame 10.

A base fabric that may be used with the invention includes 11-count or 14-count Aida fabric.

Figure 1B:
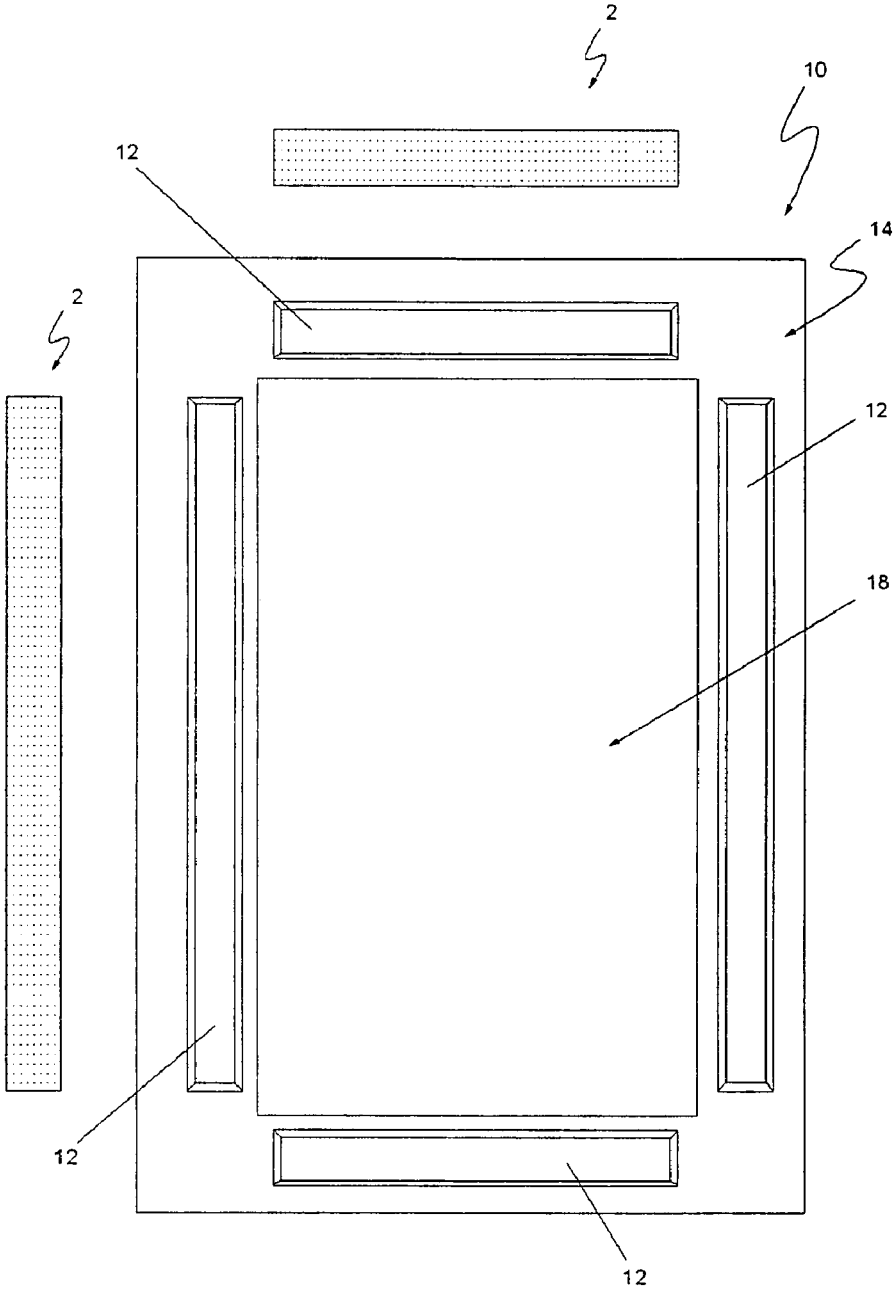
FIG. 1B is a plan view of a fabric frame.

Referring to FIG. 1A, which illustrates a cross-sectional view of a gripper strip 2, the gripper strip comprises a support membrane 4 and a plurality of hooks or pins 6 (e.g., rigid members) embedded therein and extending generally perpendicular to the plane of the support membrane 4. FIG. 1B illustrates an exemplary embodiment of a generally rectangular fabric frame 10. While the invention is described in the form of a generally rectangular frame for the sake of brevity, the invention includes other shapes, including, but not limited to, circular, oval, triangular, and polyhedral. The fabric frame 10 includes recesses 12 on the top surface of the fabric frame 14 configured to receive gripper strips 2 around the perimeter of the fabric frame 10 such that a plurality of the hooks or pins 6 extend above the top surface of the fabric frame 14 and are capable of engaging a base fabric laid over the fabric frame 10.

The gripper strips 2 are typically arranged in a pairwise fashion, such that the strips are on opposing sides of the fabric frame 10. Hence, the gripper strip 2 shown at the top of FIG. 1B is cut to the length of, and inserted into, the recess 12 shown immediately below it, which is sized to receive the gripper strip 2. A corresponding gripper strip 2 (not shown) would be inserted into the bottom recess 12 illustrated in FIG. 1B. Likewise, the gripper strip 2 shown on the left side of FIG. 1B is inserted into the recess 12 immediately to its right in FIG. 1B and a corresponding gripper strip 2 (not shown) is inserted in the left most recess 12 of FIG. 1B. Thus, each pair of gripper strips 2 allow the base fabric to be tensioned along either the X or Y axis of the fabric frame 10.

Figure 2:
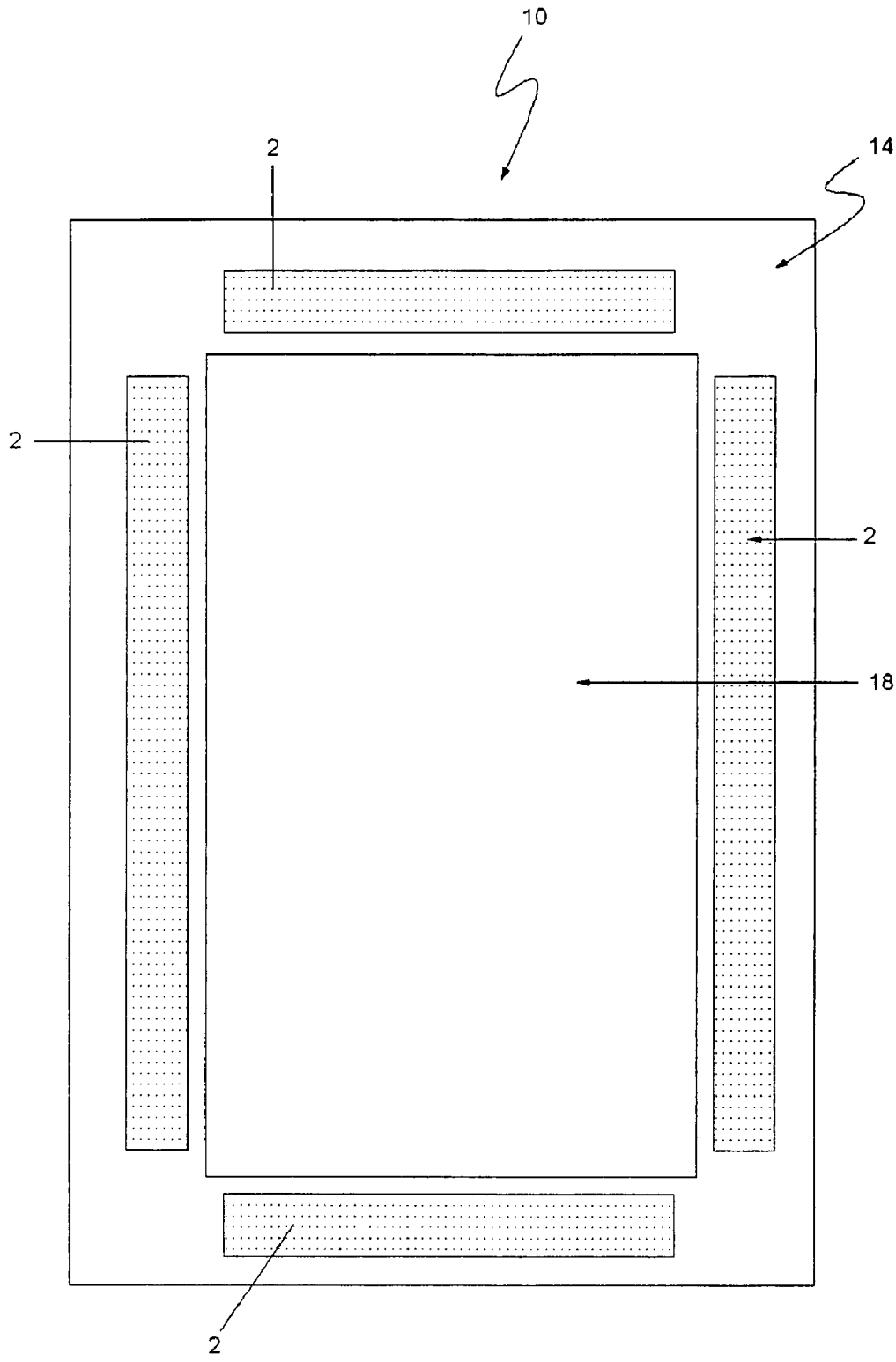
FIG. 2 is a plan view of a fabric frame with four gripper strips adhered thereto.

FIG. 2 illustrates an exemplary embodiment of a generally rectangular fabric frame 10 with four gripper strips 2 (two pairs) adhered in the recesses 12 (FIG. 1B) arranged around the perimeter of the fabric frame 10 such that the gripper strips are capable of engaging a base fabric laid over the fabric frame. In this exemplary embodiment the top surface of the fabric frame 14 is generally planar and the gripper strips 2 are on the top surface of the fabric frame 14.

Figure 3:
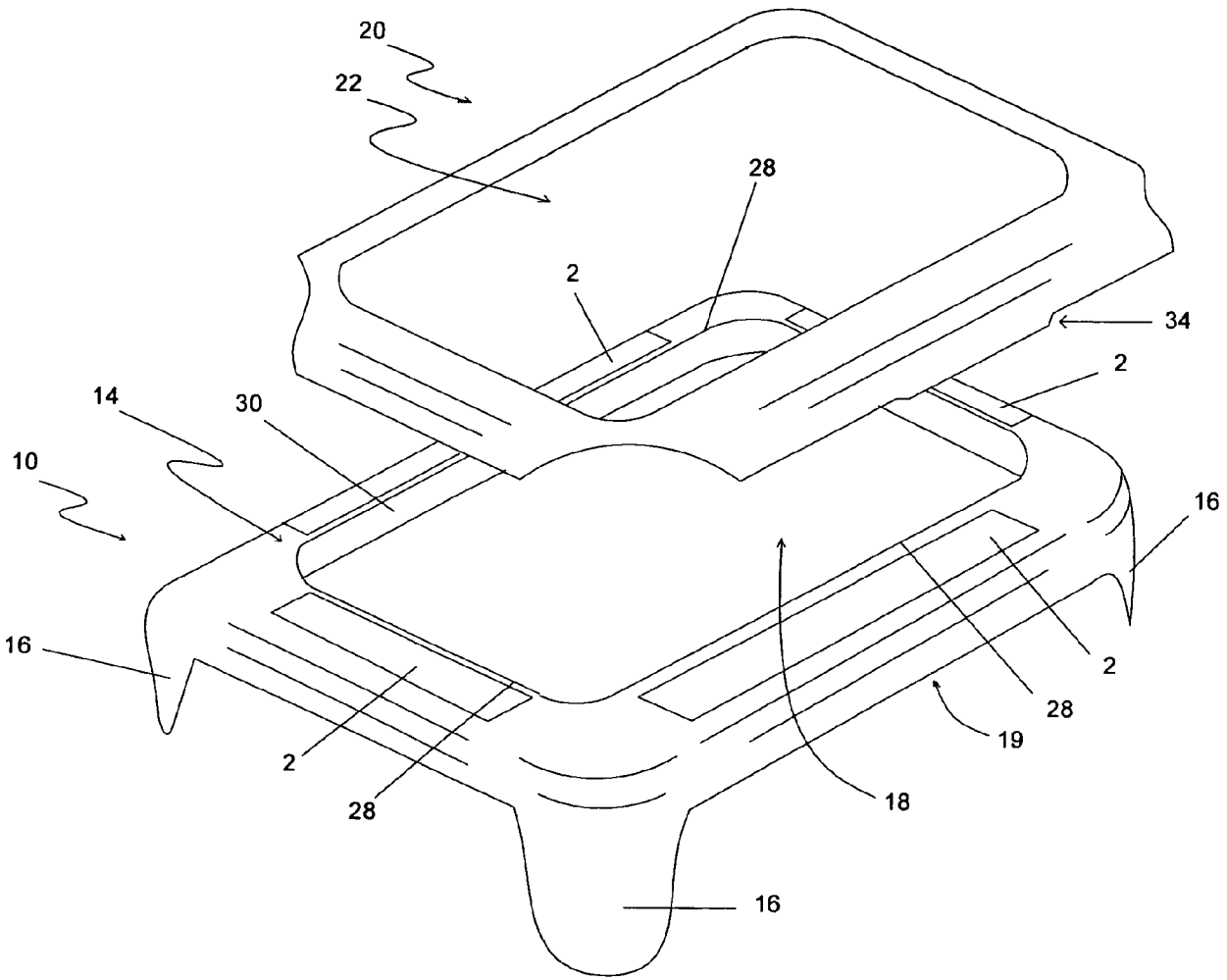
FIG. 3 is an expanded view of an embroidery frame of the invention comprising a fabric frame and frame cover.

Referring to FIG. 3, which illustrates another exemplary embodiment of a fabric frame 10. Fabric frame 10 has four gripper strips 2 positioned around the perimeter of the fabric frame 10. In this embodiment, fabric frame 10 also includes legs 16 configured to raise the fabric frame 10 above a work surface, such as a table, thereby allowing the user access to a needle or thread under the fabric frame 10. As illustrated in FIGS. 2-3, the fabric frame 10 defines a fabric frame opening 18 over which the base fabric is to be tensioned using the gripper strips 2. FIG. 3 also illustrates an exemplary embodiment of a frame cover 20 according to the invention. The frame cover 20 is configured to have a frame cover opening 22 that substantially aligns with the fabric frame opening 18 when the frame cover 20 is attached to the fabric frame 10. The frame cover 20 includes two or more engagement members 24 (FIGS. 7, 9 and 10) configured to frictionally engage the fabric frame 10 on a bottom surface of the fabric frame 19 and thereby releaseably attach the frame cover 20 to the fabric frame 10.

While the invention is illustrated by way of the engagement members 24 engaging the bottom surface of the fabric frame 19, the engagement members 24 may also engage the fabric frame 10 at positions other than the bottom of the fabric frame 19, such as by engagement in a groove or by way of a slot and tab configuration.

Figure 4:
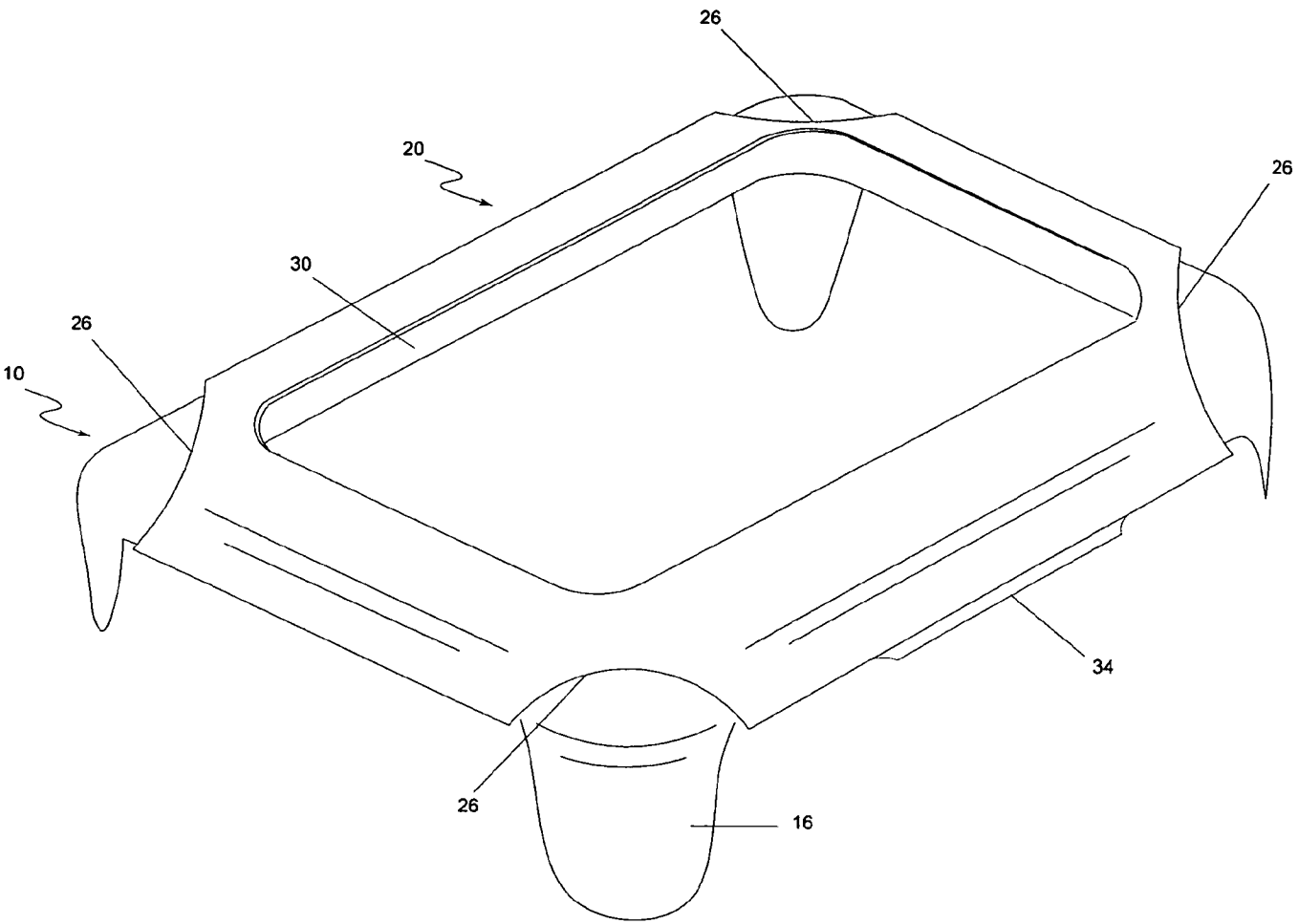
FIG. 4 is an elevated oblique view of the frame cover attached to the frame shown in FIG. 3.

FIG. 4 shows the frame cover 20 releasably attached to the fabric frame 10 and covering the gripper strips 2. The frame cover 20 is configured to match the contours of the top surface of the fabric frame 14 and engage the bottom surface of the fabric frame 19. In the exemplary embodiment illustrated in FIGS. 3 and 4 the corners of the frame cover 20 have an arched cut away 26, such that when the engagement members 24 are engaged with the bottom surface of the fabric frame 19, the corners of the fabric frame 10 are exposed, but the gripper strips 2 are substantially covered. It should be noted that when the frame cover 20 is engaged with the fabric frame 10, the fabric frame opening 18 and the frame cover opening 22 are substantially aligned along the inner edge 28 of the top surface of the fabric frame 14. Inner walls 30 extend downwardly from the top surface of the fabric frame 14 and surround the fabric frame opening 18 to provide structural rigidity to the fabric frame. The downward curvature or convex shape of the top surface of the fabric frame 14 (and corresponding shape of the frame cover 20) advantageously increase the ability of the invention to secure the base fabric to the gripper strips and/or make tensioning the base fabric easier. Furthermore, the arched cut away 26 on each corner of the frame cover 20 and absence of gripper strips 2 on each corner combine to facilitate draping of the base fabric over the corners of the fabric frame 10, where the base fabric will have a tendency to fold. Therefore, the arched cut away allows for tighter attachment of the frame cover 20, since the tolerance between the top surface of the fabric frame 14 and the frame cover 20 can be reduced.

Figure 5:
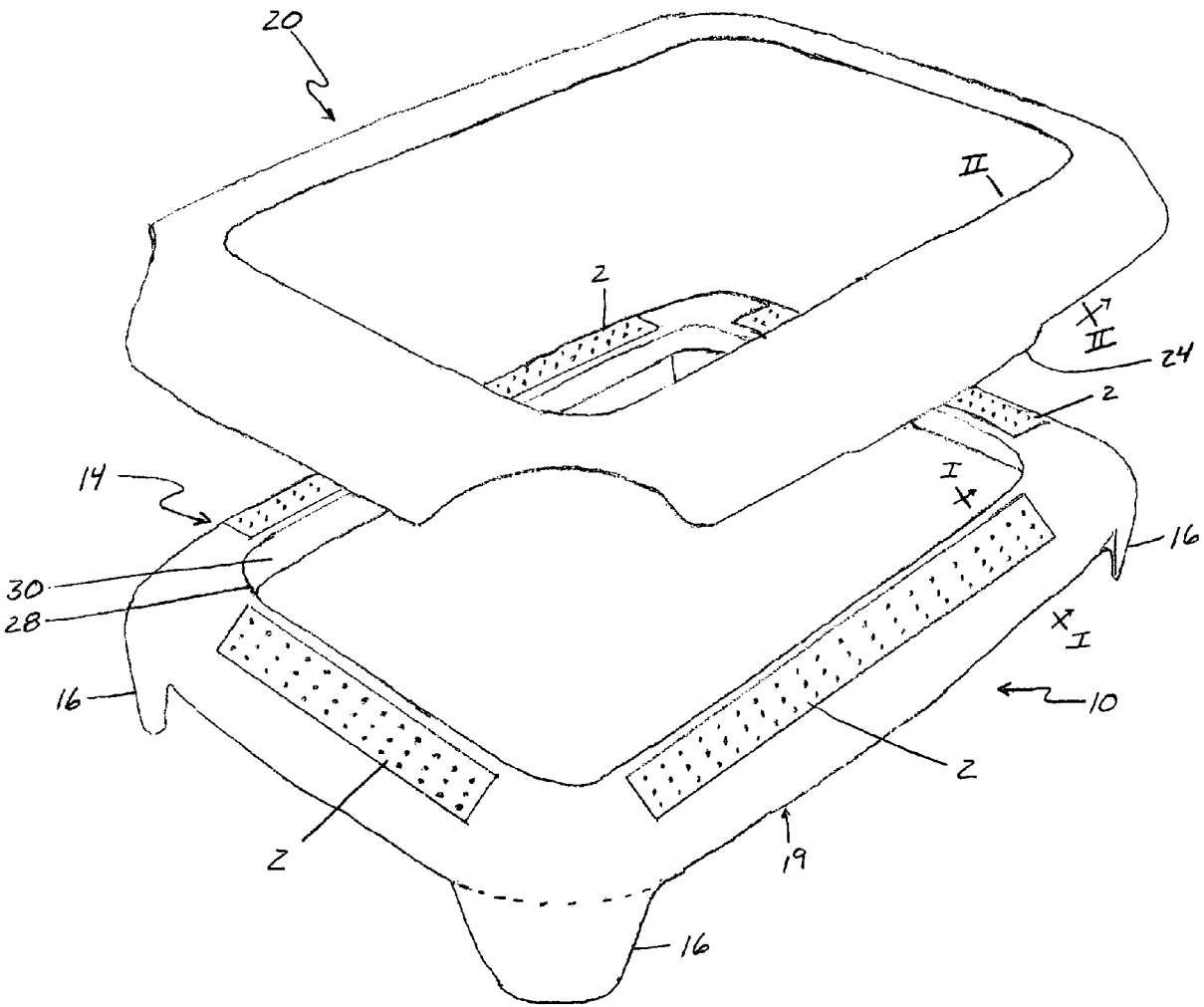
FIG. 5 is an expanded view of an embroidery frame of the invention comprising a fabric frame and frame cover.

FIG. 5 illustrates another exemplary embodiment where the fabric frame 10, including the legs 16 and recesses 12 are formed as a single piece of plastic, for example, by injection molding a plastic material. In addition, in this exemplary embodiment the frame cover 20 and engagement members 24 are also formed as a single piece of plastic, for example, by injection molding. Gripper strips 2 are adhered in the recesses 12 by use of an adhesive (e.g., glue) such that the hooks or pins 6 of the gripper strip 2 protrude above the top surface of the fabric frame 14. In this exemplary embodiment the top surface of the fabric frame 14 has a generally convex curvature slopping down to the bottom of the fabric frame 19.

Figure 6:
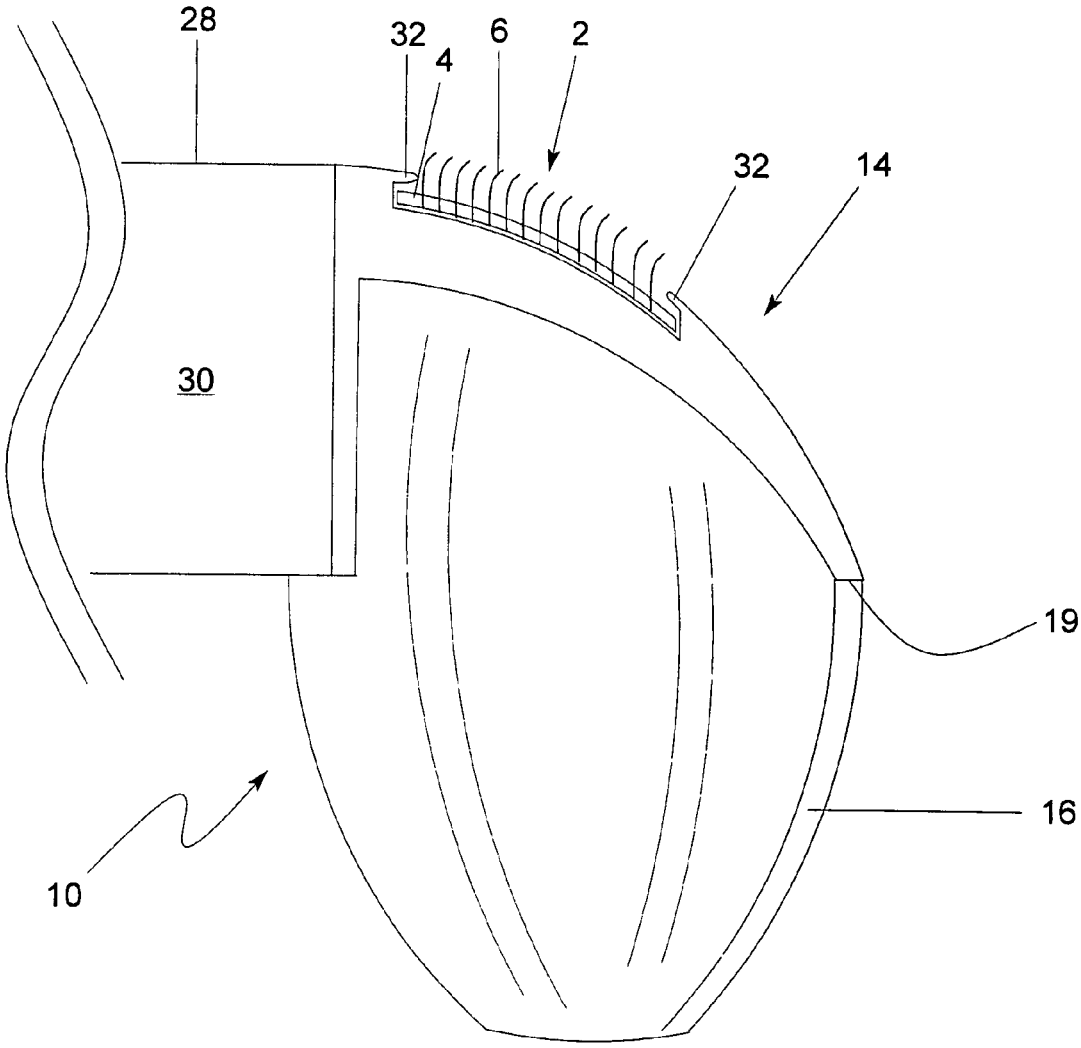
FIG. 6 is a partial cross-sectional view taken along the line I-I of FIG. 5.

FIG. 6 illustrates a partial cross-sectional view along line I-I in FIG. 6 where the top surface of the fabric frame 14 has a generally downwardly arched slope between the inner edge 28 and bottom of the fabric frame 19. In this exemplary embodiment recess 12 has retaining ridges 32 that overhang the recess 12 and retain the support membrane 4 of the gripper strip 2 within the recess 12, preferably without the need for adhesive.

Figure 7:
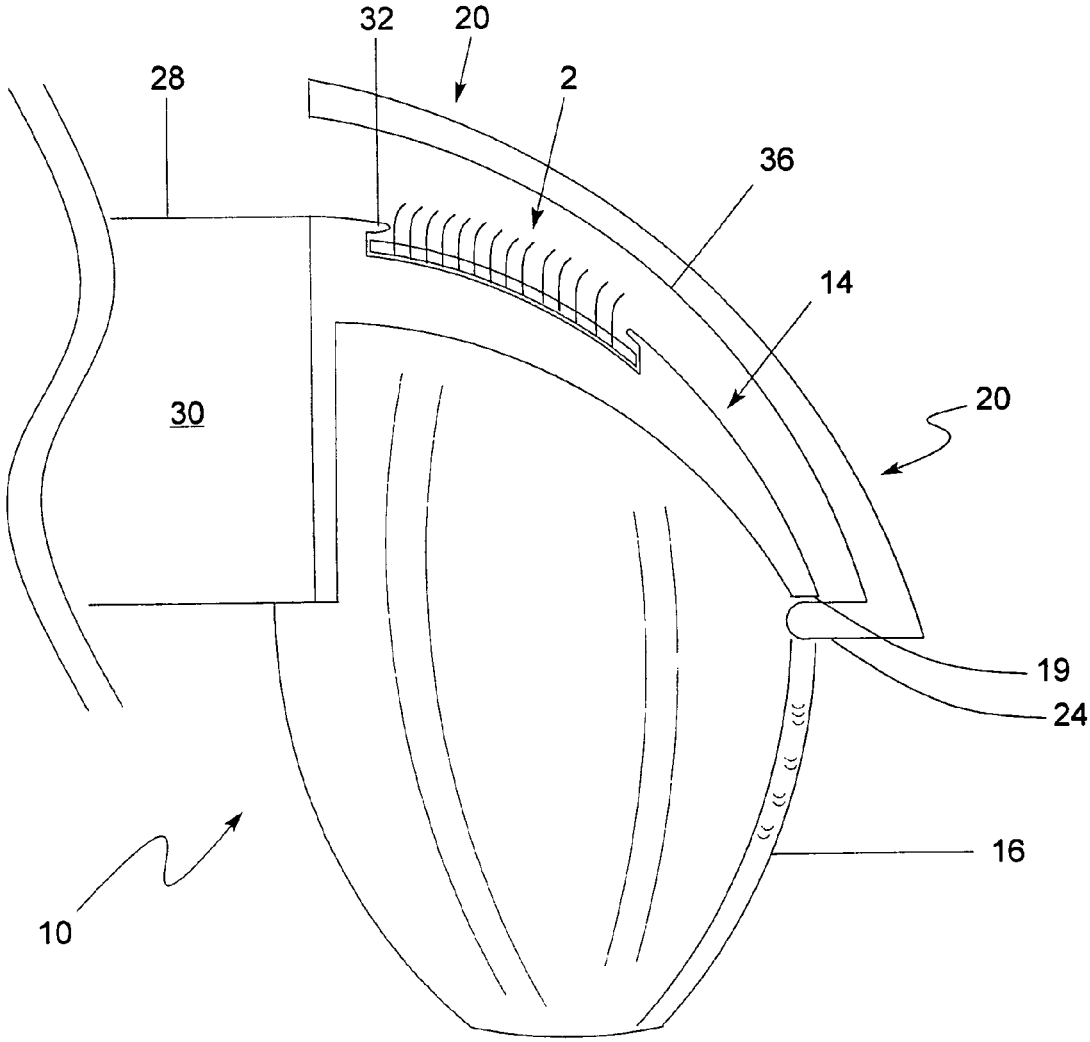
FIG. 7 is a partial cross-sectional view taken along the lines I-I and II-II of FIG. 5 with the frame cover attached to the fabric frame.

FIG. 7 illustrates a partial cross-sectional view along line I-I and II-II in FIG. 5 when the frame cover 20 is engaged with fabric frame 10 and lines I-I and II-II are aligned vertically. Frame cover 20 is configured to mate with fabric frame 10 and is configured with engagement member 24 adapted for frictional attachment (e.g., snap locking) of the frame cover 20 to the fabric frame 10 by engagement with the bottom surface of the fabric frame 19. The frictional attachment system of the invention may comprise a continuous or discontinuous engagement member 24 on opposing sides of the frame cover, a plurality of Snap Latches, or other means for detachable engagement of the frame cover 20 to the fabric frame 10. FIG. 7 also illustrates the inner surface of the frame cover 36, which runs substantially parallel to the top surface of the frame 14 and is configured to provide a space between the inner surface of the frame cover 36 and the top surface of the frame 14 and gripper strips 2. In view of FIGS. 5, 7 and 8, it will be apparent that there may or may not be an intervening side between the top surface of the frame 14 and the bottom surface of the frame 19 and a frame cover configured to mate with such a frame will be configured such that the inner surface of the frame cover 36 also runs substantially parallel to any such intervening side.

Figure 8:
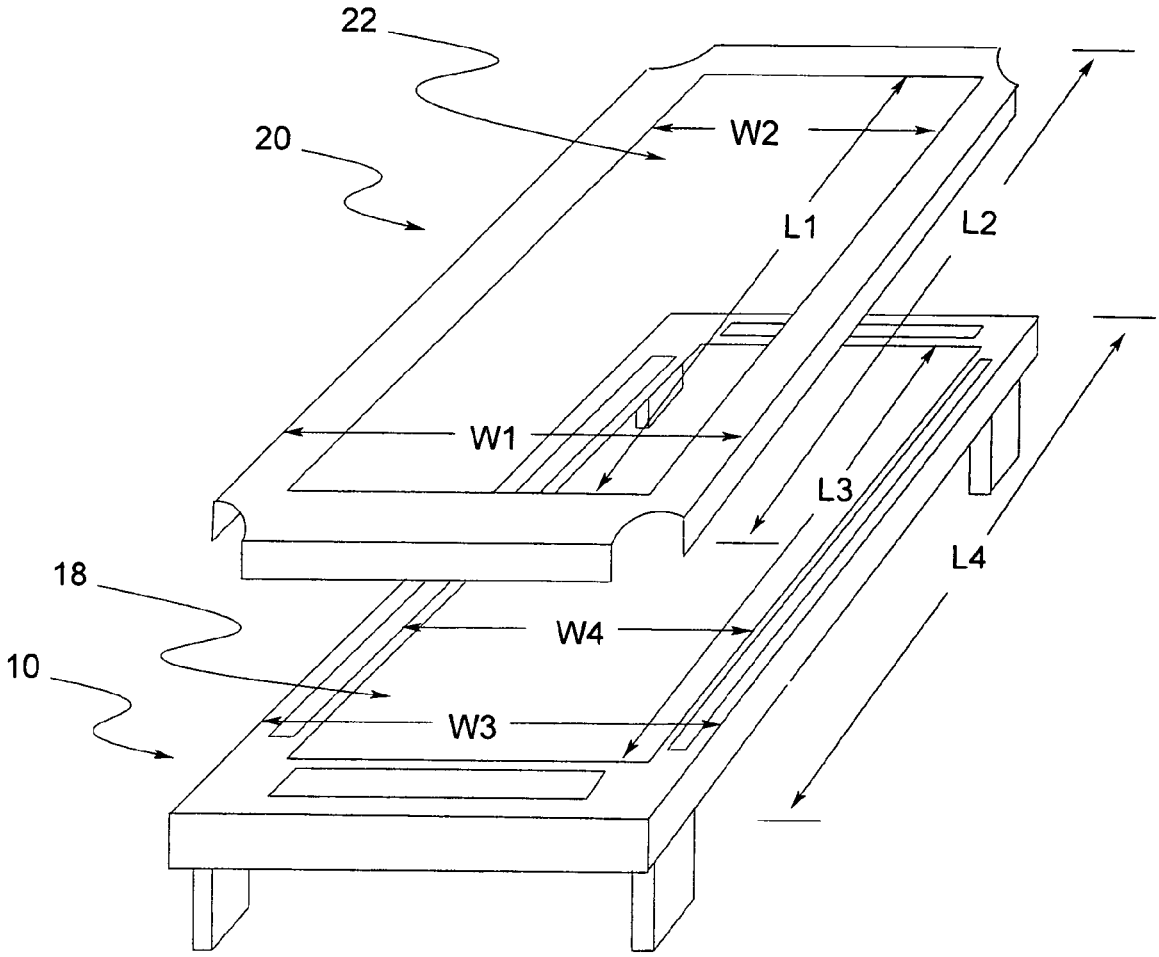
FIG. 8 is an expanded view of a fabric frame and frame cover.

Referring to FIG. 8, which illustrates another exemplary embodiment of an embroidery frame, where the frame cover 20 of the invention is configured to be mated with the fabric frame 10. Therefore, the width of the fabric frame opening 18 is illustrated as W4 and the width of the frame cover opening 22 is illustrated as W2, where W4 is approximately equal to W2. Likewise, the length L1 of the frame cover opening 22 and the length L3 of the fabric frame opening 18 are approximately equal (i.e., W4≈W2 and L1≈L3), and the frame cover opening 22 corresponds in size and geometry to the fabric frame opening 18. While a generally rectangular frame is used to illustrate the invention, alternative shapes may be used and the frame cover 20 sized accordingly. Further, the width of the fabric frame 10, as measured from the distal edges that the frame cover 20 needs to span, is illustrated as W3 and the width of the frame cover 20 is illustrated as W1, wherein W3 is slightly shorter than W1. It will be apparent from FIG. 8 that the width W1 of the frame cover 20 will be slightly longer than the width W3 of the fabric frame 10 to allow the frame cover 20 to mate with or extend over the fabric frame 10. More particularly, the difference between W1 and W3 may be adjusted as required by the engagement members 24, flexibility of the frame cover 20 and/or the tolerance for the presence of a base fabric (i.e., the space between the top surface of the fabric frame 14 and the frame cover 20). The same applies to the distance L2 relative to the distance L4. For example, the engagement members 24 may extend inwardly a sufficient distance to allow engagement of the frame cover 20 with the fabric frame 10 when a base fabric is between the engagement member 24 and the bottom surface of the fabric frame 19. For the purposes of describing the invention the relationship of W1 and W3, as well as L2 and L4, may be referred to as substantially similar or configured to be mated together.

Figure 9:
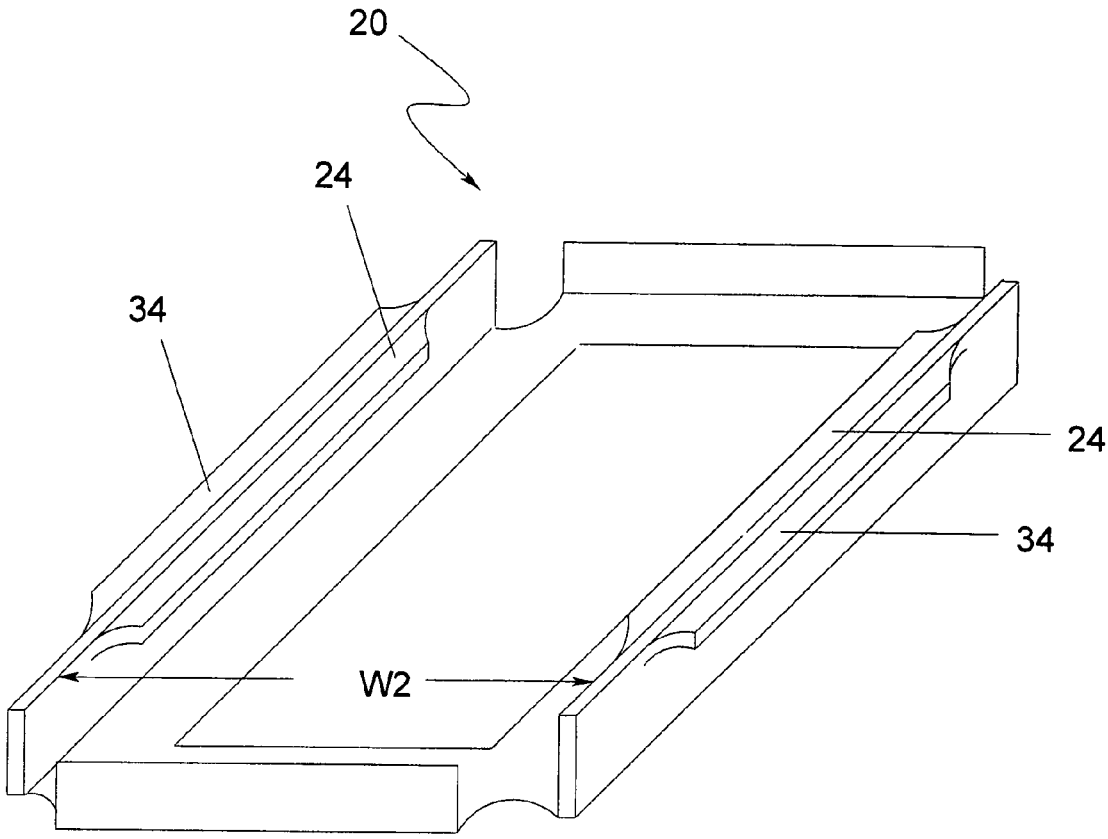
FIG. 9 is a perspective view of an inverted frame cover.

FIG. 9 illustrates an exemplary embodiment of a frame cover 20 viewed from the bottom and having a grasping means 34 (see also, FIGS. 3, 4, and 5), such as a ridge, projection or tab, configured to assist the user in flexing the frame cover 20 or engagement member 24 sufficiently to allow engagement and disengagement of the frame cover 20 with the fabric frame 10. As illustrated in FIG. 9, the engagement members 24 are preferably paired on opposing sides of the frame cover 20 and may be a simple rigid member configured to engage the fabric frame 10.

Figure 10:
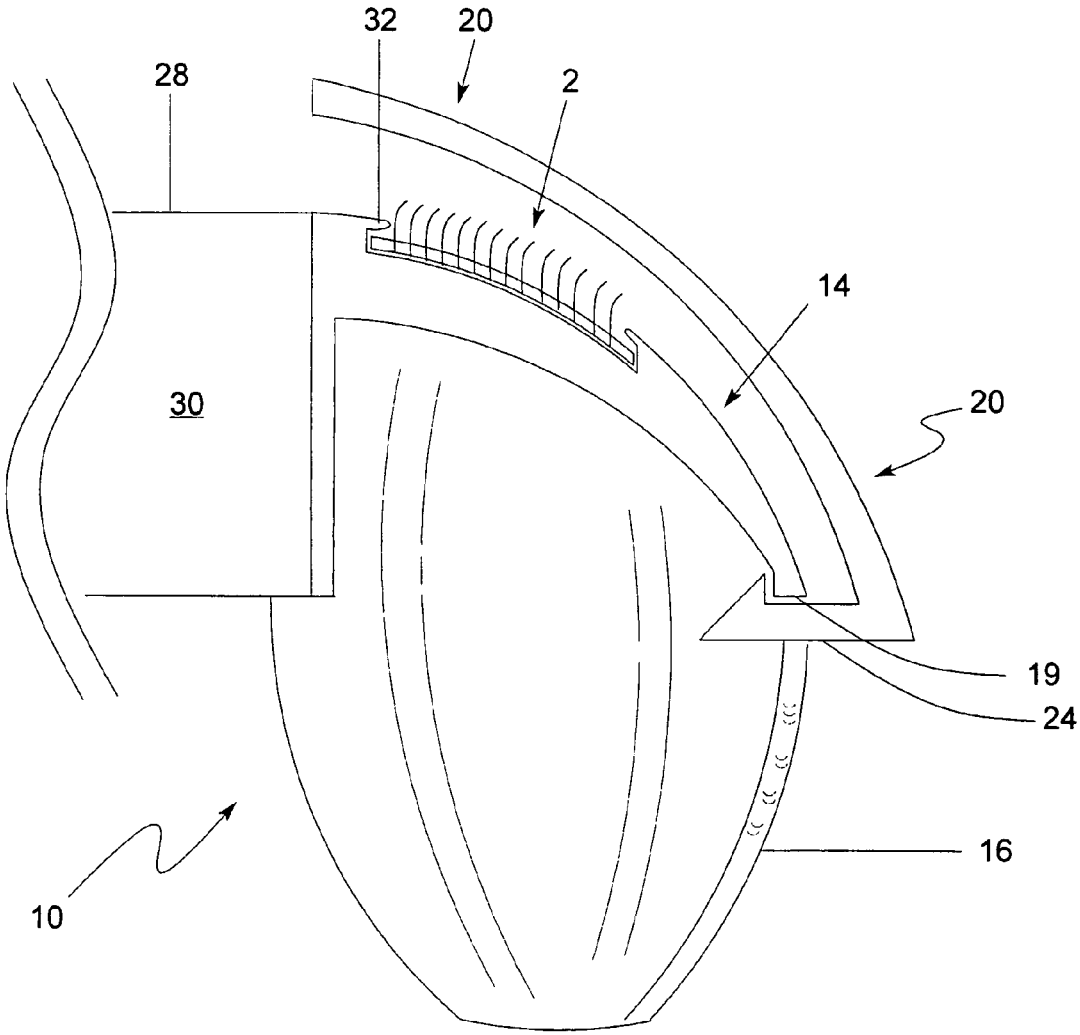
FIG. 10 is a partial cross-sectional view taken along the lines I-I and II-II of FIG. 5 illustrating an alternative embodiment of the engagement member 24.

FIG. 10 illustrates a partial cross-sectional view along line I-I and II-II in FIG. 5 when the frame cover 20 is engaged with the fabric frame 10 and lines I-I and II-II are aligned vertically. Frame cover 20 is configured to mate with fabric frame 10 having a gap between the fabric frame 10 and the frame cover 20 sufficient to accept a base fabric. In this exemplary embodiment the engagement member 24 is a snap lock having an angled end to assist frictional attachment and detachment.

A feature of the frame cover 20, when it is attached to the fabric frame 10, is that a base fabric is restrained from disengaging the hooks or pins 6 of the gripper strips 2. Therefore, when a base fabric is tensioned across the top surface of the fabric frame 14, and the frame cover 20 is attached to the fabric frame 10, user generated forces associated with passing a needle and thread up through the base fabric will be restrained from pulling the base fabric up off the gripper strip 2. Thereby reducing damage to the base fabric caused by repeated engagement and disengagement from the gripper strip 2. Reducing damage to the base fabric will greatly facilitate blocking, pressing, and framing a completed embroidery work. In addition, reducing damage to the base fabric is critical when the base fabric is a delicate material or where the area contacted by the gripper strips 2 will be visible in the finished work. An additional benefit of the invention is that a user is protected from the hooks and pins 6 of the gripper strip 2 during use and storage of the embroidery frame.

The fabric frame 10 and frame cover 20 of the invention may be of any desirable size. In an exemplary embodiment the fabric frame 10 and frame cover 20 are sized so as to be workable by an individual user on their lap.

The frame cover 20 of the invention may be sold separately from, but configured to engage, a particular fabric frame 10 style, size and/or configuration. In an exemplary embodiment, the frame cover 20 and fabric frame 10 comprise a single embroidery frame system.

In an exemplary embodiment, at least the frame cover 20 is made of a deformable or flexible material, such as plastic, to facilitate snap locking the frame cover 20 to the fabric frame 10. Suitable plastics include, but are not limited to, Polyester, Cellulose Nitrate, Poly Urethane, Nylon, Poly Sulfone, Poly Carbonate, Polyethylene terephthalate (PETE), high density Polyethylene (HDPE), low density Polyethylene (LDPE), Vinyl, Polyvinylchloride, Polypropylene (PP), and Polystyrene (PS).

In general, the present invention provides an improved embroidery frame. An exemplary embodiment of the embroidery frame of the present invention is manufactured in two unitary parts making it easier to handle, manufacture, and ship. In addition, the two unitary parts may be made of plastic, making the embroidery frame light weight and easy to use. The invention utilizes the advantages of a gripper frame while overcoming many of the drawbacks associated with such frames, such as base fabric wear due to repeated engagement and disengagement from the gripper strips during use, and irritation caused by the user's contact with the gripper strips. The embroidery frame of the invention also makes storage of the system easier, since the gripper strips are covered and will not grab undesired fabrics and threads commonly stored with the frame.

All references, including publications, patents, and patent applications, cited herein are hereby incorporated by reference to the same extent as if each reference were individually and specifically indicated to be incorporated by reference and were set forth in its entirety herein.

While this invention has been described in certain embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An embroidery frame, comprising:

at least one pair of gripper strips;

a fabric frame having a fabric frame opening, a top surface, a bottom surface, and at least one pair of recesses formed in the top surface of the fabric frame, wherein the at least one pair of recesses are arranged across the fabric frame opening and configured to receive the at least one pair of gripper strips;

a frame configured to mate with the fabric frame and having a frame cover opening corresponding in size and geometry to the fabric frame opening, an inner surface, and a plurality of engagement members extending inwardly and adapted to releasable engage the bottom surface of the fabric frame and align the frame cover opening above the fabric frame opening, wherein the inner surface of the frame cover runs substantially parallel to the top surface of the fabric frame, wherein engagement of the frame cover to the fabric frame results in the frame cover overlaying the at least one pair of gripper strips received by the at least one pair of recessed formed in the top surface of the fabric frame.

2. The embroidery frame of claim 1, wherein the fabric frame is a unitary structure.

3. The embroidery frame of claim 1, wherein the fabric frame comprises at least three legs.

4. The embroidery frame of claim 1, wherein the fabric frame and frame cover are plastic.

5. The embroidery frame of claim 1, wherein the fabric frame is a rounded rectangle.

6. The embroidery frame of claim 5, wherein the frame cover has an arched cut away at each corner.

7. The embroidery frame of claim 1, wherein the at least one pair of gripper strips are adhered in the at least one pair of recesses.

8. The embroidery frame of claim 1, wherein the at least one pair of recesses have retaining ridges configured to secure the at least one pair of gripper strips.

9. The embroidery frame of claim 1, wherein the frame cover is made of a flexible plastic.

10. The embroidery frame of claim 1, wherein the frame cover further comprises a plurality of grasping means.

11. The embroidery frame of claim 1, wherein the top surface of the fabric frame has a downward curvature running from an inner edge of the top surface to the bottom of the fabric frame.

12. The embroidery frame of claim 11, wherein the fabric frame is a rounded rectangle having four sides at right angles to one another and a leg at each corner.

13. The embroidery frame of claim 12, wherein the fabric frame is a unitary plastic structure and there is a single recess on each of the four sides.

14. The embroider frame of claim 13, wherein the frame cover is a rounded rectangle having an arched cut away at each corner and two engagement members on opposing sides and wherein the frame cover is made of flexible plastic.

15. An embroidery method for reducing stress to the base fabric, the method comprising:

stretching a base fabric over a fabric frame having a fabric frame opening, a top surface, a bottom surface, at least one pair of recesses formed in the top surface, and at least one pair of gripper strips disposed in the at least one pair of recesses;

attaching a frame cover configured to mate with the fabric frame, wherein the frame cover comprises a frame cover opening corresponding in size and geometry to the fabric frame opening, an inner surface, and a plurality of engagement members adapted to releasably engage the bottom surface of the fabric frame;

aligning the frame cover opening above the fabric frame opening and covering the at least one pair of gripper strips; and preventing the force generated by passing a needle and one or more threads through the base fabric to produce an image on the base fabric from at least partially disengaging the base fabric from the gripper strips.

16. The method according to claim 15, further comprising producing the fabric frame as a unitary structure.

17. The method according to claim 15, wherein producing the fabric frame as a unitary structure comprises injection molding plastic.

18. The method according to claim 17, comprising providing a plastic frame cover.

19. The method according to claim 15, comprising providing a generally rectangular fabric frame.

20. The method according to claim 15, comprising providing the top surface of the fabric frame with a downward curvature running from an inner edge of the top surface to the bottom of the fabric frame.

21. The method according to claim 20, comprising producing the fabric frame as a generally rectangular unitary plastic structure and adhering a gripper strip on each side of the generally rectangular fabric frame.

22. An embroidery frame, comprising:

at least one pair of gripper strips;

a fabric frame having a fabric frame opening, a top surface, a bottom surface, and at least one pair of recesses formed in the top surface of the fabric frame, wherein the at least one pair of recesses are arranged across the fabric frame opening and configured to receive the at least one pair of gripper strips;

a frame configured to mate with the fabric frame and having a frame cover opening corresponding in size and geometry to the fabric frame opening, an inner surface, and a plurality of engagement members extending inwardly and adapted to releasable engage the bottom surface of the fabric frame and align the frame cover opening above the fabric frame opening, wherein the inner surface of the frame cover runs substantially parallel to the top surface of the fabric frame, wherein engagement of the frame cover to the fabric frame results in the frame cover overlaying the at least one pair of gripper strips received by the at least one pair of recessed formed in the top surface of the fabric frame, wherein the at least one pair of gripper strips are adhered in the at least one pair of recesses.

* * * * *